US005636775A

United States Patent [19]

Kartsotis et al.

[11] Patent Number: 5,636,775

[45] Date of Patent: Jun. 10, 1997

[54] WATCH STRAP POUCH

[75] Inventors: Tom Kartsotis, Dallas; Suzanne M. Amundsen, McKinney; Timothy G. Hale, Garland, all of Tex.; Hiroshi Nakahara, Chiba, Japan

[73] Assignee: Fossil, Inc., Richardson, Tex.

[21] Appl. No.: 499,479

[22] Filed: Jul. 7, 1995

[51] Int. Cl.[6] ..... A44C 5/00

[52] U.S. Cl. ..... 224/165; 224/236; 224/267; 224/930; D3/226; D3/228; D3/230; D10/32

[58] Field of Search ..... 224/203, 206, 224/224, 240, 239, 236, 165, 275, 253, 252, 209, 215, 267, 902, 908, 918, 930; D3/215, 226, 228, 230; D10/32, 31, 30

[56] References Cited

U.S. PATENT DOCUMENTS

| | | | |
|---|---|---|---|
| D. 104,572 | 5/1937 | Lewis . | |
| D. 329,024 | 9/1992 | Robbins | D10/31 |
| D. 348,776 | 7/1994 | Anderson | D3/226 |
| D. 351,281 | 10/1994 | Petryk | D3/230 |
| 1,434,775 | 11/1922 | Fenno . | |
| 1,606,667 | 11/1926 | Rosenberg | D3/228 |
| 2,317,820 | 4/1943 | Smith | 224/240 |
| 3,147,896 | 9/1964 | Kehl | 224/240 |
| 3,780,918 | 12/1973 | Curtis | D10/32 |
| 4,406,385 | 9/1983 | Pribyl | 224/908 |
| 4,756,458 | 7/1988 | Clifton | 224/252 |
| 4,785,981 | 11/1988 | Rodman | 224/165 |
| 5,009,348 | 4/1991 | Derkatz | 224/253 |
| 5,386,933 | 2/1995 | Greene et al. | 224/267 |

FOREIGN PATENT DOCUMENTS

| | | | |
|---|---|---|---|
| 455366 | 7/1968 | Switzerland | 224/165 |
| 18955 | 8/1913 | United Kingdom | 224/165 |

OTHER PUBLICATIONS

"Popular Photography" Dec., 1959.

*Primary Examiner*—Henry J. Recla
*Assistant Examiner*—Timothy L. Maust
*Attorney, Agent, or Firm*—Randall C. Brown; James F. Struthers; Locke Purnell Rain Harrell

[57] ABSTRACT

A storage receptacle adapted to be received on a watch strap or jewelry band.

17 Claims, 1 Drawing Sheet

WATCH STRAP POUCH

BACKGROUND OF THE INVENTION

1. Field of the Invention

The present invention relates to a pouch for use in connection with straps and bands, and particularly for use in connection with a wristwatch strap. The watch strap pouch provides a convenient wristwatch-based storage receptacle for snake-bite kits, coins, pills and other small objects.

2. Description of Related Information

Many people find it desirable to carry small objects on their person. Such a need could arise, for example, for medical reasons, as in the case of pills or a snake-bite kit. People often use their pockets, or supplemental means such as a purse or bag, to convey these smaller objects. However, the intermingling of items in pockets and purses, and the risk of damage to objects therein, often makes such means undesirable. Moreover, some people may prefer to travel without a purse or without pockets on occasion.

It is known to provide a receptacle that is engaged with a watch strap for the aforementioned purposes. Such a receptacle offers many advantages including increased convenience, and protection against forgetfulness for those who habitually remember to wear a watch, but cannot remember to carry some small object with them. A watch-based receptacle is especially advantageous to those for whom the watch has become an unobtrusive, indispensable accessory.

Watch-based receptacles in the past suffered from a variety of disadvantages. For example, watch-based receptacles in the past were often unattractive. Since wristwatches today are as much a fashion accessory as a time-telling means, watch-based storage means should preferably complement the overall appearance of the watch.

Watch-based receptacles in the past also offered less flexibility than is desirable in such a device. For example, some receptacles were integral with the strap. For those users that do not wish to continuously wear the receptacle, an integral mechanism, or a mechanism permanently affixed to the watch by cement, rivets or the like is undesirable. The integral nature of some watch-based receptacles in the past also contributed to added manufacturing expense. To improve flexibility, and to lower expense, a receptacle that may be easily attached to and removed from a variety of watch straps is highly desirable.

It is also desirable to provide a watch strap receptacle that minimizes interference with the wrist. Watch-based receptacles in the past were often cumbersome in design, being so large that interference with wrist motion could be expected. The receptacles were also unable to accommodate the curvature of the wrist without undesirable flexing and discomfort to the user.

A need exists, therefore, for a watch-based receptacle that allows its user to store small items on a wristwatch strap, that features economy and simplicity of design, that is flexible, that is easy to securely install on and remove from a variety of watch straps, and whose appearance does not detract from the overall appearance of the watch.

SUMMARY OF THE INVENTION

The apparatus of the present invention overcomes the above-mentioned disadvantages and drawbacks which are characteristic of the related information. The watch strap pouch of the present invention comprises a receptacle which is secured to a wristwatch strap, which is in turn secured to the user's wrist.

In a preferred embodiment, the watch strap pouch of the present invention comprises a sleeve attached to a pouch. Access to the pouch is provided by an orifice which may be exposed, or which may be covered by a flap connected to the pouch or the sleeve. In a preferred embodiment, the flap may be secured over the orifice using a snap fastener engaged between the flap and the pouch.

The sleeve is adapted to slide onto a watch strap, and in a preferred embodiment comprises an outside element, which abuts both the outside of the strap and the pouch, and an inside element, which abuts the user's wrist and the inside of the strap. In a preferred embodiment, the inside element comprises a cutout portion to facilitate bending of the sleeve in response to bending of the strap.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings.

DESCRIPTION OF THE PREFERRED EMBODIMENTS

Figure 1:
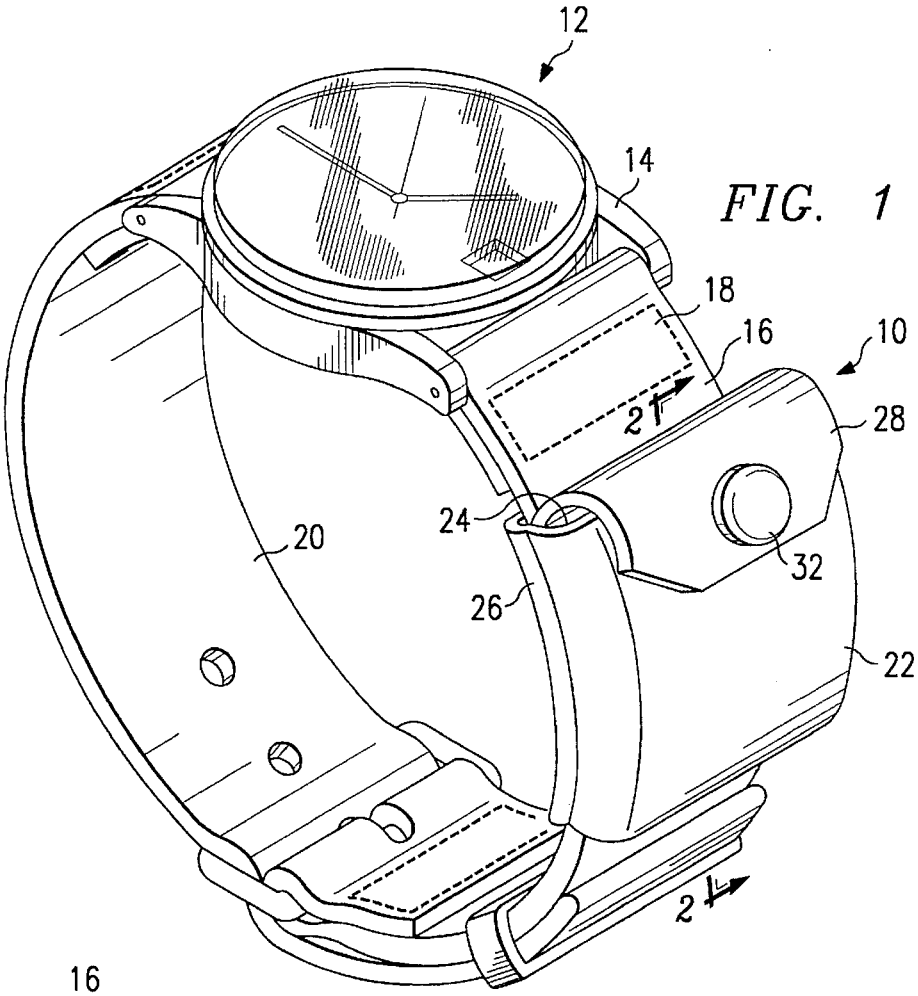
FIG. 1 is a perspective view of the watch strap pouch of the present invention, shown installed on a wristwatch strap.
Figure 2:
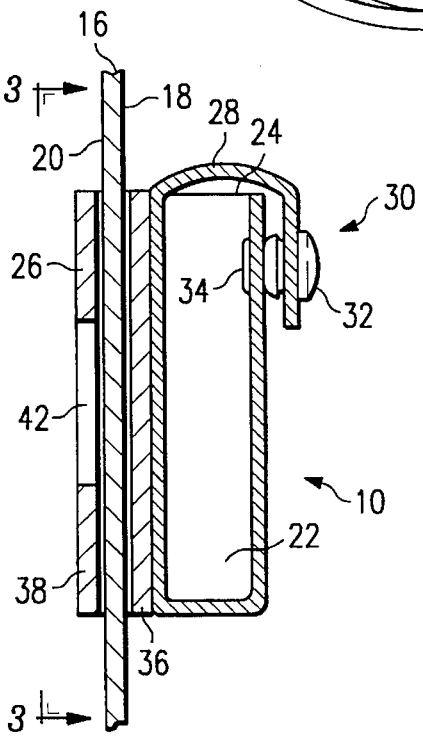
FIG. 2 is a section view taken along line 2—2 of FIG. 1.
Figure 3:
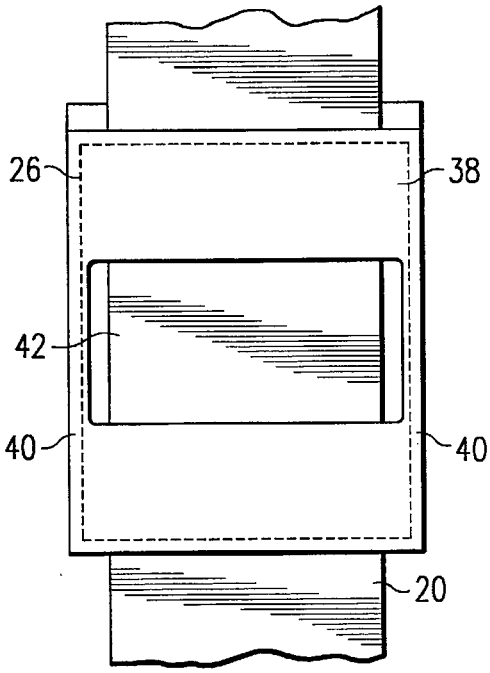
FIG. 3 is a plan view taken along line 3—3 of FIG. 2.

Referring now to the drawings, a preferred embodiment of the watch strap pouch of the present invention is shown and generally designated by the reference numeral 10.

In a preferred embodiment, the watch strap pouch 10 of the present invention is used in connection with a wristwatch 12, which comprises a watch body 14 and a strap or continuous band 16 which wraps around the user's wrist. The strap 16 typically has an outside 18, which faces away from the wrist, and an inside 20 which faces towards the wrist. Those of ordinary skill in the art will recognize that the watch strap pouch 10 of the present invention can be used in conjunction with any jewelry band, including bracelets and the like.

In a preferred embodiment, the watch strap pouch 10 comprises a pouch 22 having an orifice 24, and a sleeve 26 which is adapted to slide around the watch strap 16. In a preferred embodiment, a flap 28 is connected to and extends from the pouch 22 at the edge of the orifice 24, and may be pulled over the orifice 24 to prevent the pouch contents from falling out.

Those of ordinary skill in the art will recognize that the pouch 22 and flap 28 may be rigid, or may be made of a soft or flexible material such as leather. Those of ordinary skill in the art will also recognize that the flap 28 may be integral with the pouch 22, and that the flap 28 may also be connected to and extend from the sleeve 26.

In a preferred embodiment, a snap fastener 30 is used to hold the flap 28 over the orifice 24. The snap fastener 30 comprises a first part 32 connected to the flap 28 which may be matingly engaged with a second part 34 connected to the pouch 22. Those of ordinary skill in the art will recognize that a variety of fastening means may be used to secure the flap 28, including Velcro®, string, buttons and similar means.

The sleeve 26 is connected to the pouch 22 so as to form a loop through which the strap 16 may pass. In a preferred embodiment, the sleeve 26 comprises an outside element 36, which abuts the outside 18 of the strap 16, and an inside element 38, which abuts the inside 20 of the strap 16. The outside and inside elements 36, 38 of the sleeve 26 are connected at two opposing edges 40. In between the connected edges 40, the outside and inside elements 36, 38 are not connected, allowing the watch strap 16 to pass therethrough.

In a preferred embodiment, the inside element 38 comprises a cutout portion 42 to facilitate bending of the sleeve 26 in response to bending of the strap 16. The cutout portion 42 is preferably rectangular and extends beyond the width of the strap 16.

A sleeve 26 according to the present invention may be used to secure objects other than a pouch 22 to the strap 16 of a wristwatch. For example, a compass, thermometer, or other device may be attached to the outside element 36 of the sleeve 26 using means readily understood by those skilled in the art.

Those of ordinary skill in the art will recognize that many sleeve designs well-understood in the art are compatible with the present invention. For example, the sleeve 26 need not comprise two elements 36, 38. A single, continuous element could be connected at two distinct points on the pouch, thereby forming a complete loop and sleeve. Moreover, the sleeve 26 need not be a complete loop. For example, resilient claws could extend from the pouch 22 to grasp the strap 16.

In operation of the watch strap pouch 10 of the present invention, the watch strap 16 is inserted through the sleeve 26. The watch strap 16 is then attached to the user's wrist such that the cutout portion 42 of the sleeve 26 abuts the user's wrist, and such that the pouch 22 projects outwardly from the strap 16. The flap 28 is drawn over the orifice 24 and the snap fastener 30 is closed to secure the contents of the pouch 22. The snap fastener 30 may be released and the flap 28 pulled back to access the pouch contents.

In a preferred embodiment, the watch strap pouch 10 is oriented such that the orifice 24 points along the strap 16 towards the watch body 14. Those of ordinary skill in the art will recognize that the orientation of the pouch 22 may be varied as desired at the manufacturing stage. In addition, using methods well known to those skilled in the art, including the use of a snap fastener disposed between the pouch and the sleeve, a user-adjustable pouch orientation is possible.

Those of ordinary skill in the art will further recognize that the watch strap pouch 10 may be used in connection with a continuous band. For example, the sleeve 26 may be engaged with the band before the band is attached to the watch body 14. The pouch 22 may be made removable by using a disengageable connection, such as a snap fastener, between the pouch 22 and the sleeve 26. Alternatively, a discontinuity along the sleeve 26, which could be alternately opened or closed, would allow the sleeve itself to be engaged on or disengaged.

While preferred embodiments of the invention have been shown and described, it will be understood by persons skilled in the art that various changes and modifications may be made without departing from the spirit and scope of the invention which is defined by the following claims.

What is claimed is:

1. A watch and pouch combination, comprising:

a) a watch, comprising:

i) a watch body; and ii) a watch strap, said watch strap being engaged with said watch body and adapted for securement to a user's wrist; and b) a pouch assembly comprising:

i) a sleeve adapted to receive said watch strap;

ii) a flexible pouch connected to said sleeve, said pouch having an access orifice extending tangentially of a user's wrist; and iii) a flap connected to said pouch, said flap having an open position and a closed position, wherein said flap covers said orifice when said flap is in said closed position, and wherein said orifice is exposed and opens away from said user's wrist when said flap is in said open position.

2. A watch and pouch combination according to claim 1 wherein said pouch is made of leather.

3. A watch and pouch combination according to claim 1 wherein said orifice of said pouch points substantially along said watch strap.

4. A watch and pouch combination according to claim 1 further comprising means for alternately fastening said flap in said closed position and unfastening said flap from said closed position.

5. A watch and pouch combination according to claim 4 wherein said fastening means comprise a snap fastener engageable between said flap and said pouch.

6. A watch and pouch combination, comprising:

a) a watch, comprising:

i) a watch body; and ii) a watch strap, said watch strap being engaged with said watch body and adapted for securement to a user's wrist; and b) a pouch assembly, comprising:

i) a sleeve adapted to receive said watch strap;

ii) a flexible pouch connected to said sleeve, said pouch having an access orifice extending tangentially of a user's wrist; and iii) a flap connected to said sleeve, said flap having an open position and a closed position, wherein said flap covers said orifice when said flap is in said closed position, and wherein said orifice is exposed and opens away from said user's wrist when said flap is in said open position.

7. A watch and pouch combination according to claim 6 further comprising means for alternately fastening said flap in said closed position, and unfastening said flap from said closed position.

8. A watch and pouch combination according to claim 7 wherein said fastening means comprise a snap fastener engageable between said flap and said pouch.

9. A watch and pouch combination according to claim 1 wherein said sleeve comprises an inside element and an outside element, said outside element being connected to said pouch, said inside element being connected to said outside element and comprising means to accommodate flexing of said watch strap.

10. A watch and pouch combination according to claim 9 wherein said flex-accommodating means comprise a cutout portion of said inside element.

11. A watch and pouch combination according to claim 10 wherein said cutout portion is rectangular.

12. A watch and pouch combination according to claim 11 wherein said rectangular cutout portion is wider than said watch strap.

13. A watch and pouch combination according to claim 1 wherein said sleeve comprises an element having two ends, each said end being connected to said pouch.

14. A watch and pouch combination according to claim 13 wherein said element comprises means to accommodate flexing of said watch strap.

15. A watch and pouch combination according to claim 14 wherein said flex-accommodating means comprise a cutout portion of said inside element.

16. A watch and pouch combination according to claim 15 wherein said cutout portion is rectangular.

17. A watch and pouch combination according to claim 16 wherein said rectangular cutout portion is wider than said watch strap.

* * * * *